US011027548B2

(12) United States Patent
Takeuchi et al.

(10) Patent No.: US 11,027,548 B2
(45) Date of Patent: Jun. 8, 2021

(54) LIQUID EJECTION HEAD AND METHOD OF MANUFACTURING SAME

(71) Applicant: CANON KABUSHIKI KAISHA, Tokyo (JP)

(72) Inventors: Souta Takeuchi, Fujisawa (JP); Takuya Hatsui, Tokyo (JP); Masataka Kato, Hiratsuka (JP); Masaya Uyama, Kawasaki (JP); Toru Nakakubo, Kawasaki (JP); Tomohiro Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/452,162

(22) Filed: Jun. 25, 2019

(65) Prior Publication Data

US 2020/0001604 A1 Jan. 2, 2020

(30) Foreign Application Priority Data

Jun. 29, 2018 (JP) ..... JP2018-125045

(51) Int. Cl.
*B41J 2/14* (2006.01)

(52) U.S. Cl.
CPC ..... *B41J 2/14072* (2013.01); *B41J 2/14201* (2013.01); *B41J 2002/14491* (2013.01)

(58) Field of Classification Search
CPC ..... B41J 2/14072; B41J 2/14088; B41J 2/14201; B41J 2002/14491
See application file for complete search history.

(56) References Cited

U.S. PATENT DOCUMENTS

2015/0251426 A1* 9/2015 Yokoyama ..... B41J 2/1607 347/50
2016/0101574 A1* 4/2016 Mou ..... B29C 64/25 425/375
2017/0021622 A1* 1/2017 Takahashi ..... B41J 2/16

FOREIGN PATENT DOCUMENTS

JP 2002-67328 A 3/2002

* cited by examiner

*Primary Examiner* — Jason S Uhlenhake
(74) *Attorney, Agent, or Firm* — Canon U.S.A, Inc. I.P. Division

(57) ABSTRACT

A liquid ejection head includes an ejection port member that includes an ejection port that ejects a liquid, an energy generating element that generates energy for ejecting the liquid from the ejection port, a terminal electrically connected to the energy generating element, and a substrate portion that supports the ejection port member, the energy generating element, and the terminal. The terminal is connected to a wire member that supplies electric power that drives the energy generating element to the energy generating element, the substrate portion includes a hole portion formed from a surface of the substrate portion on a side opposite to a surface of the substrate portion on which the terminal is provided to a surface where the terminal is exposed, and an area of the surface where the terminal is exposed is smaller than an area of an opening of the hole portion.

19 Claims, 13 Drawing Sheets

LIQUID EJECTION HEAD AND METHOD OF MANUFACTURING SAME

BACKGROUND OF THE INVENTION

Field of the Invention

The present disclosure relates to a liquid ejection head and a method of manufacturing the same.

Description of the Related Art

In recent years, recording using an ink jet recording apparatus is performed not only on a paper medium but also on a non-paper medium such as a substrate and, accordingly, an ink jet recording apparatus is required to have high reliability as an industrial device.

An ink jet head includes energy generating elements that apply pressure to ink. The ink to which pressure has been applied is ejected as ink droplets to the outside of the ink jet head through ejection ports, and an image or the like is formed by applying the ink droplets on a medium such as paper. Electric connection portions (electrode pads) that supply electric power from the outside to drive the energy generating elements are formed in element substrates in which the energy generating elements are formed. The electric connection portions are sealed with sealing members formed of a resin material or the like to suppress adhesion of ink.

Since there are cases in which the printing quality becomes degraded due to adhesion and fixing of the ink droplets to portions near the ejection ports, a cleaning operation that removes the adhered ink droplets needs to be performed with a blade-like member. The ink droplets are removed by moving the blade member pressed against the vicinities of the ejection ports of the element substrates. In so doing, there are cases in which the blade member abutting against the sealing members of the electric connection portions, which may affect the cleaning in some cases.

Accordingly, considering the cleaning, for example, it is desirable that the electric connection portions are provided in a surface in which the ejection ports are not formed. Japanese Patent Laid-Open No. 2002-67328 proposes an element substrate in which electric connection portions are formed in an area on a side (hereinafter, referred to as a back surface side of the element substrate) opposite to the surface in which the ejection ports are provided.

SUMMARY OF THE INVENTION

An aspect of the present disclosure is a liquid ejection head that includes an element substrate including an ejection port member having an ejection port that ejects a liquid, an energy generating element that generates energy for ejecting the liquid from the ejection port, a terminal electrically connected to the energy generating element, and a substrate portion; and an electric connection member that is connected to the terminal and that supplies, to the energy generating element from a portion external to the element substrate, electric power for driving the energy generating element. A hole portion is formed in the substrate portion from a second surface, which is a surface opposite to a first surface in which the energy generating element is provided, towards the first surface. The terminal is provided at a bottom portion of the hole portion, and in a direction orthogonal to a depth direction of the hole portion, an area of the hole portion at the second surface is larger than an area of the hole portion at the bottom portion.

Furthermore, an aspect of the present disclosure is a method of manufacturing a liquid ejection head that ejects a liquid, the method including preparing a substrate portion provided with an ejection port member that includes an ejection port that ejects the liquid, an energy generating element that generates energy for ejecting the liquid from the ejection port, and a terminal that is electrically connected to the energy generating element; forming a hole portion by etching from a second surface, which is a surface opposite to a first surface in which the energy generating element is provided, towards the first surface; and electrically connecting an electric connection member to the terminal provided at a bottom portion of the hole portion by inserting a tool inside the hole portion. In the hole portion formed in the forming of the hole portion, in a direction orthogonal to a depth direction of the hole portion, an area of the hole portion at the second surface is larger than an area of the hole portion at the bottom portion.

Further features of the present disclosure will become apparent from the following description of exemplary embodiments with reference to the attached drawings.

DESCRIPTION OF THE EMBODIMENTS

In order to form electric connection portions on a back surface side of an element substrate, there are cases in which a hole portion is provided in the back surface and the electric connection portions are provided inside the hole portion. However, by providing the hole portion, the strength of the element substrate decreases, which may cause deformation of the element substrate. There are cases in which the reliability of the electric connection portions is affected when the element substrate becomes deformed.

In view of the above, the present disclosure provides a liquid ejection head in which deformation of the element substrate is suppressed.

Hereinafter, liquid ejection heads according to example embodiments of the present disclosure, and a manufacturing method thereof will be described with reference to the drawings. Note that the following description does not limit the scope of the present disclosure. In the example embodiments, while a thermal ink jet head that ejects ink by creating an air bubble with a heating element is employed as an example, the present disclosure can be applied to liquid ejection heads employing a piezoelectric method and other various liquid ejecting methods. Furthermore, the liquid that is ejected is not limited to ink and various types of liquid, such as water or a conductive liquid, are applicable. Furthermore, while the liquid ejection head of the example embodiments is a so-called page-wide head that has a length corresponding to the width of a medium to be printed, the present disclosure can be applied to a so-called serial liquid ejection head that performs recording while scanning the medium. The serial liquid ejection head includes a configuration in which a single printing element substrate for black ink and a single printing element substrate for chromatic color ink are mounted, for example. However, not limited to the above, a short head that has a length shorter than the width of the medium and that includes a plurality of element substrates arranged in an ejection port array direction so as to overlap the ejection ports may be fabricated, and the short head may be configured to scan the medium.

First Example Embodiment

Description of the Liquid Ejection Head

Figure 1:
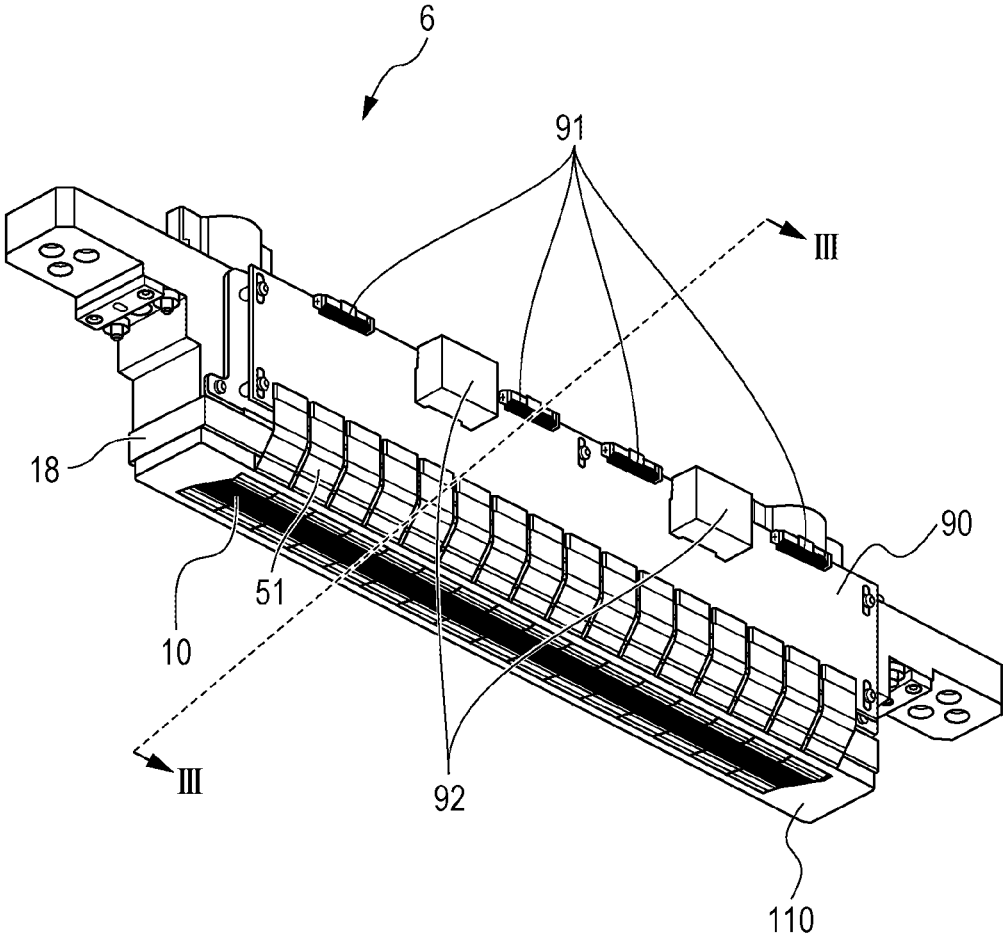
FIG. 1 is a schematic view illustrating a liquid ejection head according to example embodiments.

A liquid ejection head according to the present example embodiment will be described with reference to FIG. 1. FIG. 1 is a perspective view illustrating an overall image of a liquid ejection head 6 according to the present example embodiment. As illustrated in FIG. 1, the liquid ejection head 6 is of a page wide type in which 15 element substrates 10, each of which ejects inks of four colors C, M, Y, and K, are arranged (disposed inline) linearly in a longitudinal direction of the liquid ejection head 6. Note that, each of the element substrates 10 has a substantially parallelogram shape. The liquid ejection head 6 includes signal input terminals 91 and power supply terminals 92 that are electrically connected thereto through the element substrates 10, electric wiring members 51, and plate-shaped electric wiring substrates 90. The electric wiring members 51 are flexible wiring substrates, for example. The signal input terminals 91 and the power supply terminals 92 are electrically connected to a conveying unit (not shown) that conveys a medium to be printed (not shown) and a control unit of a recording apparatus (not shown) that includes the liquid ejection head 6 and supply an ejection drive signal and electric power needed for the ejection to the element substrates 10. By integrating the wiring with the electric circuits in the electric wiring substrates 90, the number of signal input terminals 91 and the number of electric power supply terminals 92 can be less than the number of element substrates 10. With the above, the number of electric connection portions that need to be removed when installing the liquid ejection head 6 in the recording apparatus or when replacing the liquid ejection head 6 can be small.

Figure 2A:
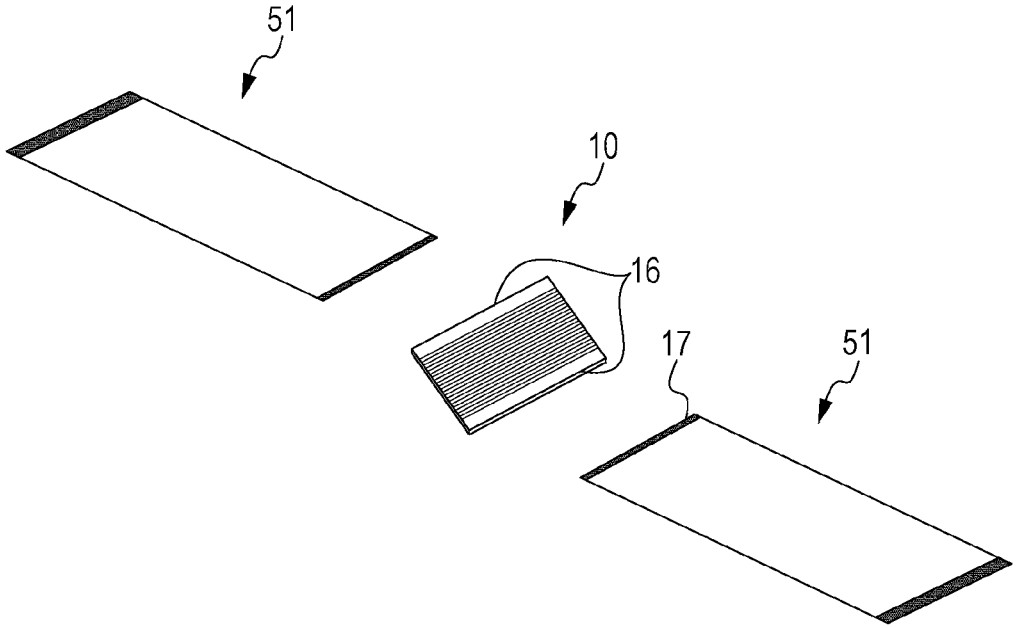
FIG. 2A is a perspective view before an element substrate and electric wiring members are connected to each other.
Figure 2B:
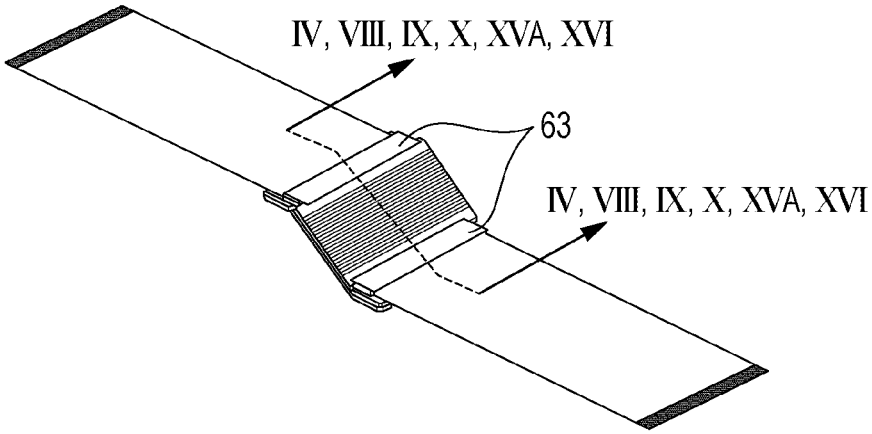
FIG. 2B is a perspective view after the element substrate and the electric wiring members have been connected to each other.

Description Regarding Connection of Element Substrates and Electric Wiring Members to Each Other Connection portions between the element substrates 10 and the electric wiring members 51 according to the present example embodiment will be described with reference to FIGS. 2A and 2B. FIGS. 2A and 2B are perspective views of a single element substrate 10 and the electric wiring members 51 among the plurality of element substrates 10 and the electric wiring members 51 provided in the liquid ejection head 6, and illustrate a side of the element substrate 10 opposite the surface in which the ejection ports of the element substrate 10 are provided. FIG. 2A is a perspective view before the element substrate 10 and the electric wiring members 51 are connected to each other. FIG. 2B is a perspective view in which the element substrate 10 and the electric wiring members 51 are connected to each other. As illustrated in FIG. 2A, the element substrate 10 includes terminals 16, and each electric wiring member 51 includes terminals 17. Each terminal 16 and the corresponding terminal 17 are electrically connected to each other with an electric connection member 32 (FIG. 3) by wire lead bonding, and joining portions are covered by sealing members 63 (FIG. 2B).

Detailed Description of Liquid Ejection Head

Figure 3:
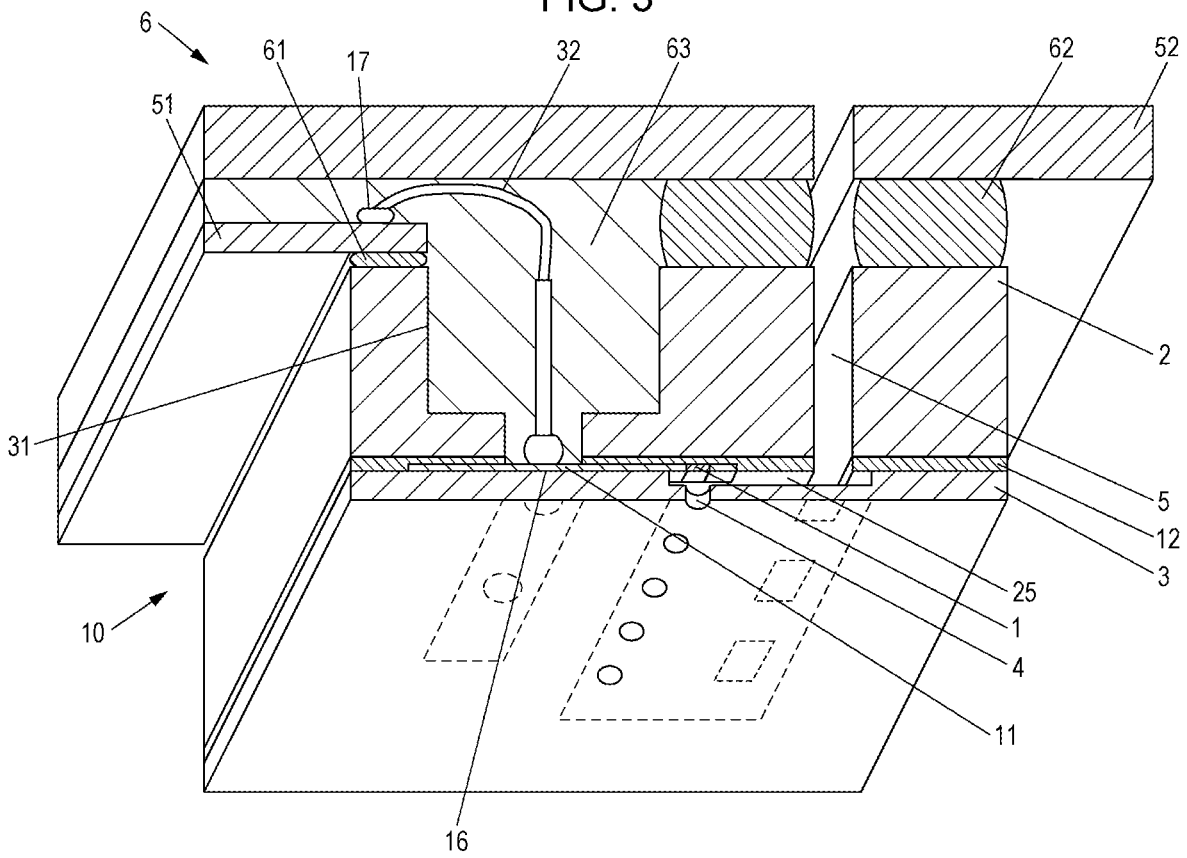
FIG. 3 is a schematic view illustrating a cross section of the liquid ejection head according to a first example embodiment.

Referring to FIG. 3, a detailed description of the liquid ejection head 6 according to the present example embodiment will be described. FIG. 3 is a perspective view of the element substrate 10 and illustrates a portion of a cross section taken along line III-III in FIG. 1. As illustrated in FIG. 3, the element substrate 10 mainly includes an ejection port member 3 that includes ejection ports 4 that eject a liquid and a flow path 25, and a substrate portion 2 made of silicon that includes liquid supply ports 5 that supply the liquid to the flow path 25. Energy generating elements 1 that supply energy to the liquid in the vicinities of the ejection ports 4, a wiring layer 11 electrically connected to the energy generating elements 1, and an insulating layer 12 are formed between the ejection port member 3 and a front surface side of the substrate portion 2. A hole portion 31 is formed in the substrate portion 2 from the back surface side of the element substrate 10 towards the wiring layer 11. The back surface of the substrate portion 2 and the electric wiring member 51 are adhered to each other with an adhesive agent 61. The terminals 16 in the wiring layer 11 and the terminals 17 in the electric wiring member 51 are electrically connected to each other with the electric connection members 32. A sealing member 63 that seals the hole portion 31 is formed inside the hole portion 31. The element substrate 10 is adhered to a head member 52 with a seal member 62 in between. Note that a transistor (not shown) or various circuits may be provided in the electric path connecting the energy generating element 1 and the terminal 16.

Electric power is supplied to the energy generating element 1 from a portion (the electric wiring member 51) external to the element substrate 10 through the electric connection member 32, the terminal 16, and the wiring layer 11. In the present example embodiment, each energy generating element 1 is a heater and the heater heats the liquid with the supplied electric power. The heated liquid is film-boiled and bubbles are generated. The liquid is ejected from the ejection port 4 with a foaming pressure of the bubbles.

Description of Element Substrate

Figure 4:
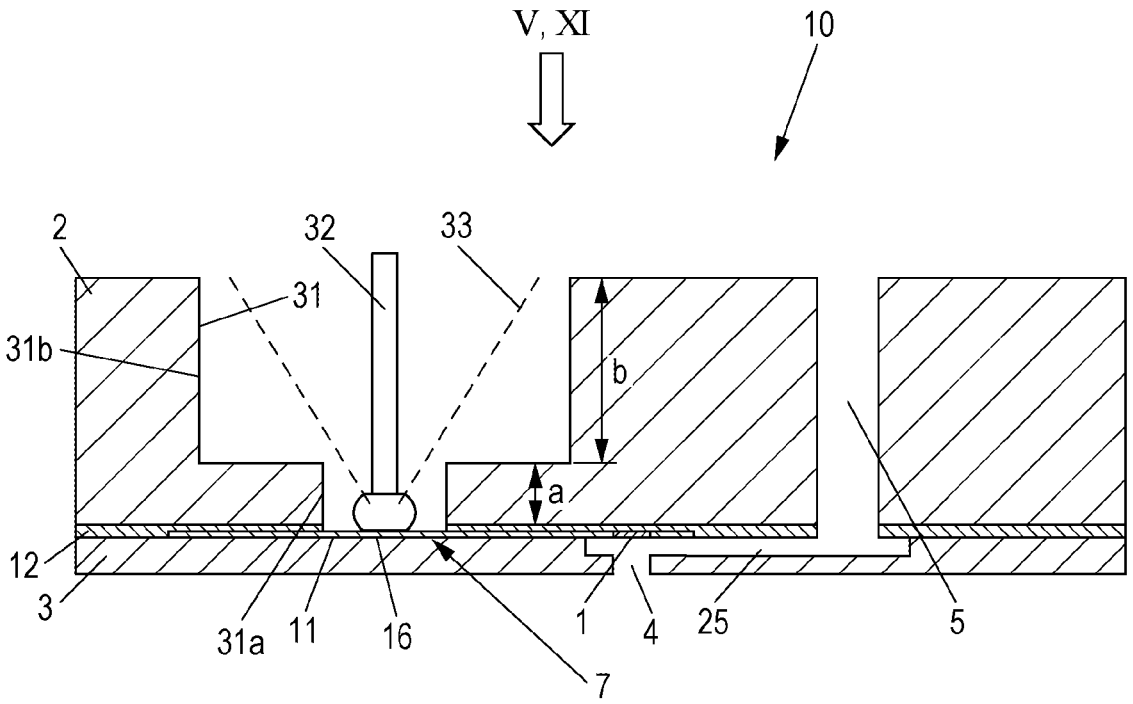
FIG. 4 is a schematic view illustrating an element substrate according to the first example embodiment.
Figure 5:
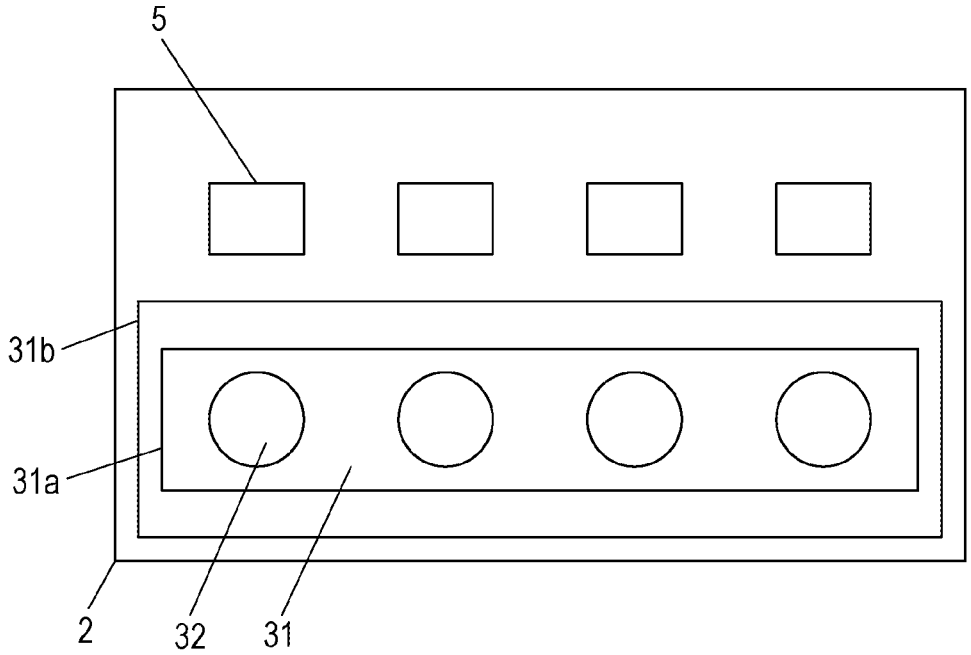
FIG. 5 is a schematic view of the element substrate according to the first example embodiment viewed in a direction V illustrated in FIG. 4.

Referring to FIGS. 4 and 5, a description of the element substrate 10, which is a feature portion of the present example embodiment, will be described. FIG. 4 is a schematic view of the element substrate 10 illustrating a portion (a configuration around the terminal 16) of a cross section taken along line IV-IV in FIG. 2B. The sealing member 63 is omitted in the illustration. Note that portions having configurations similar to those described above will be attached with the same reference numerals and description thereof will be omitted.

The hole portion 31 is formed in the substrate portion 2 made of silicon from the back surface side towards the front surface side (the terminal side) of the element substrate 10 to connect the electric connection members 32 to the terminals 16. The broken lines 33 in the drawing are lines illustrating an area where a bonding tool described later may enter. Note that a typical bonding tool has a cylindrical shape through which the wire is passed, in which the tip is thin and the base is thick. A point angle of the bonding tool is about 30 degrees. An angle formed between each broken line 33 and a plane of the wiring layer 11 is, for example, about 60 degrees to allow the bonding tool to enter. In the present example embodiment, each electric connection member 32 is a piece of wire formed of Au. The terminals 16 provided at a bottom portion 7 of the hole portion 31 and the terminals 17 (FIG. 3) provided on the electric wiring member 51 are electrically connected to each other by a so-called wire lead bonding method. When a piece of wire having a diameter of φ25 μm is used, a diameter of the bonding tool is about φ50 μm and a tip diameter of the bonding tool is about 130 μm. Accordingly, the bottom portion 7 of the hole portion 31 needs to have a width of at least 150 μm. Note that the electric connection member 32 is not limited to a piece of Au wire, and may be either one of copper, aluminum, and silver, or may be an alloy of at least any two of gold and the above three metals.

In order for the bonding tool to enter the hole portion 31, the hole portion 31 needs to, in a direction orthogonal to the depth direction of the hole portion 31, include a portion 31*b* that has an area equivalent to or larger than the area of a portion surrounded by the broken lines 33. Furthermore, the hole portion 31 includes a portion 31*a*, which has an area smaller than that of the portion 31*b*, on the terminals 16. In the present example embodiment, a thickness (a height) of the substrate portion 2 is 650 μm, a height a of the portion 31*a* is 250 μm, and an opening width is 300 μm. Furthermore, an opening width of the bottom portion 7 of the hole portion 31 is 300 μm, which is the same as the opening width of the portion 31*a*. A height b of the portion 31*b* is 400 μm, and the opening width thereof is 800 μm.

As illustrated in the drawing, the area in which the bonding tool may enter becomes smaller towards the terminal 16. Accordingly, an opening diameter of the hole portion 31 can be made smaller towards the terminal 16. In the present example embodiment, the hole portion 31 is formed so as to have a double-stepped shape so that the substrate portion 2 remains on the wiring layer 11 as much as possible while preventing the bonding tool from coming into contact with the substrate portion 2. By so doing, a thickness is obtained around the terminal 16 with the substrate portion 2, and the strength of the element substrate 10 is maintained; accordingly, reliability of the electric connection portion is improved.

FIG. 5 is a schematic view of the element substrate 10 viewed in a direction V illustrated in FIG. 4. A plurality of electric connection members 32 are formed in a single hole portion 31.

Description of Method of Manufacturing Element Substrate

Figure 6:
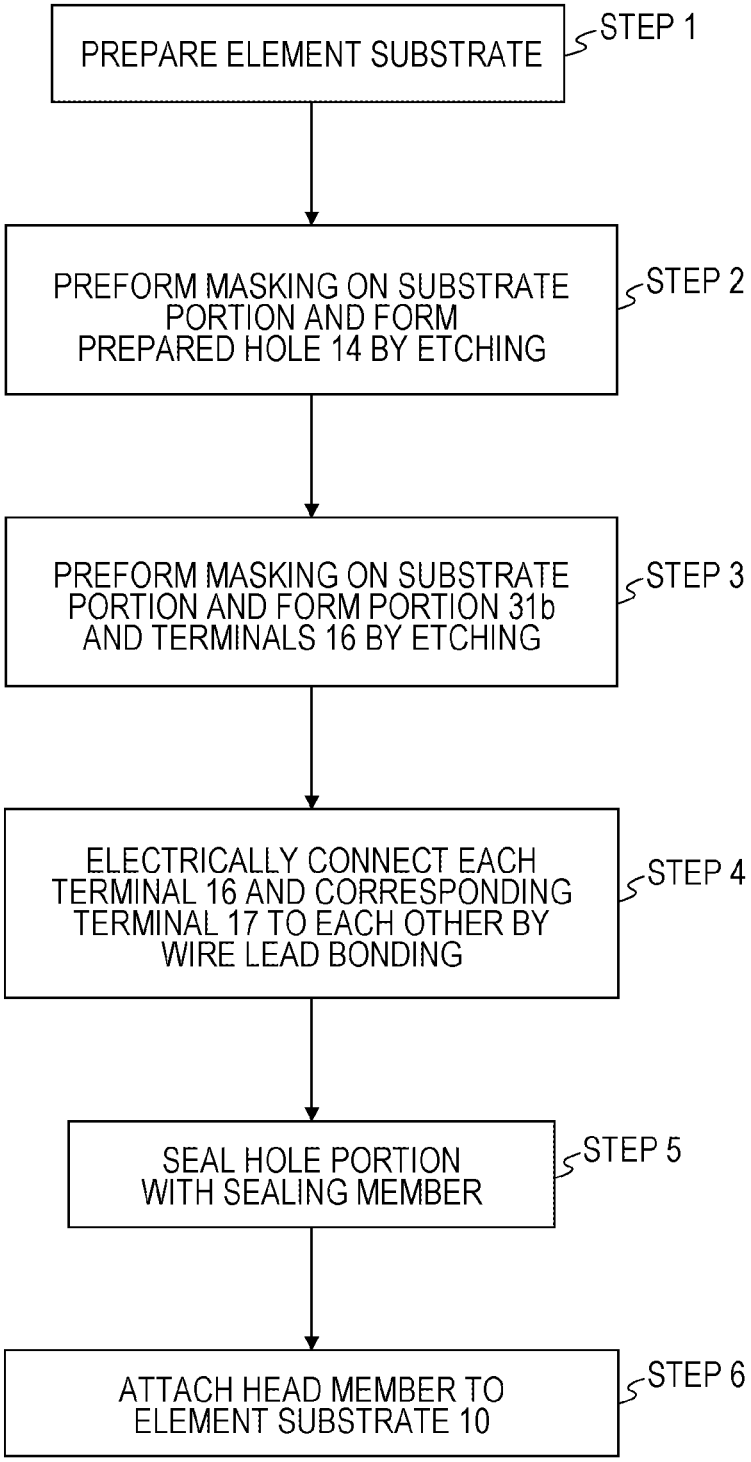
FIG. 6 is a diagram illustrating a flow of a process of a manufacturing method of the element substrate according to the first example embodiment.

Referring to FIG. 6 and FIGS. 7A to 7D, a method of manufacturing the element substrate 10, which is a feature portion of the present example embodiment, will be described. FIG. 6 is a diagram illustrating a flow of a process of the manufacturing method, and FIGS. 7A to 7D are diagrams illustrating an outline of the manufacturing method. In the present example embodiment, the hole portion is formed by performing reactive ion etching twice on a substrate portion 2 made of silicon having a thickness of 650 μm.

Figure 7A:
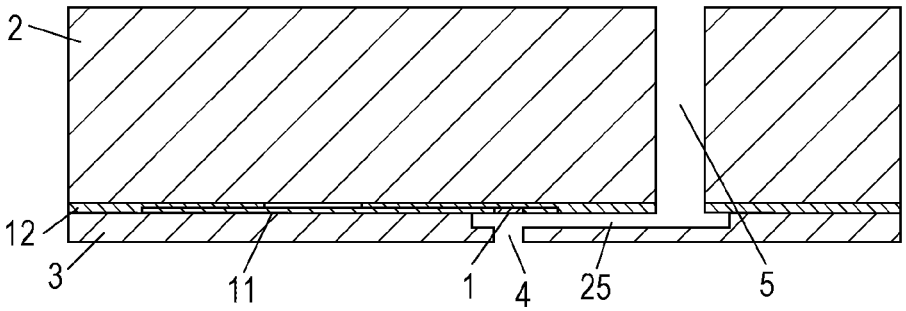
FIG. 7A is a schematic view illustrating a step of preparing the element substrate.
Figure 7B:
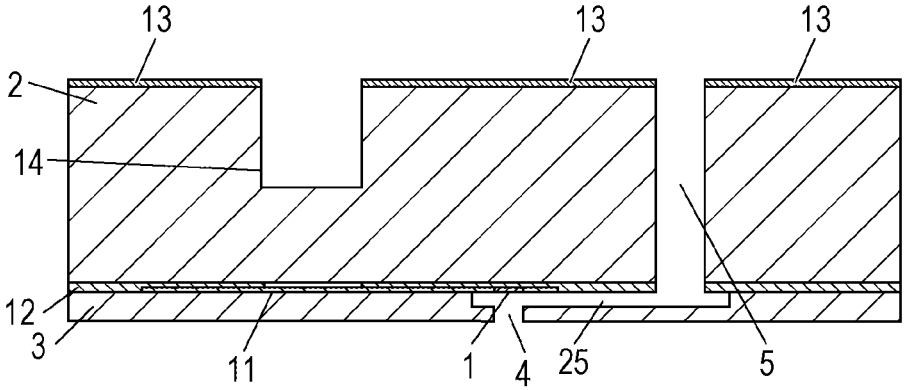
FIG. 7B is a schematic view in which a prepared hole is formed in a substrate portion.
Figure 7C:
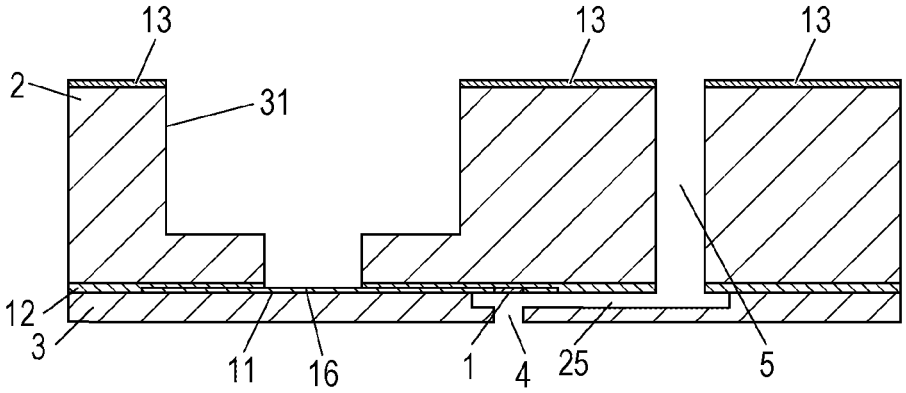
FIG. 7C is a schematic view in which a hole portion is formed in the substrate portion.

As illustrated in FIG. 7A, first, the element substrate 10 in which the wiring layer 11 and the like have been formed is prepared (step 1 in FIG. 6). Subsequently, a prepared hole 14 that is to become the portion 31*a* (FIG. 4) of the hole portion 31 is formed. A mask 13 is applied using a resist on areas other than the area in which the prepared hole 14 is formed, and the prepared hole 14 is formed in the substrate portion 2 by performing reactive ion etching (first time) from the back surface side of the element substrate 10 (step 2 in FIG. 6, FIG. 7B). Note that since the terminals 16 and the electric connection members 32 are connected to each other by inserting the bonding tool (not shown) in the hole portion 31 in a later step, the mask 13 is applied so that the width of the prepared hole 14 becomes at least 150 μm. Subsequently, an area to become the portion 31*b* (FIG. 4) of the hole portion 31 is formed. Similar to step 2, a mask 13 is applied on the substrate portion 2 and the portion 31*b* of the hole portion 31 is formed by reactive ion etching (the second time) (step 3 in FIG. 6, FIG. 7C). In so doing, the insulating layer 12 at the bottom portion of the hole portion is removed as well so that the wiring layer 11 that is to become the terminals 16 is exposed.

Figure 7D:
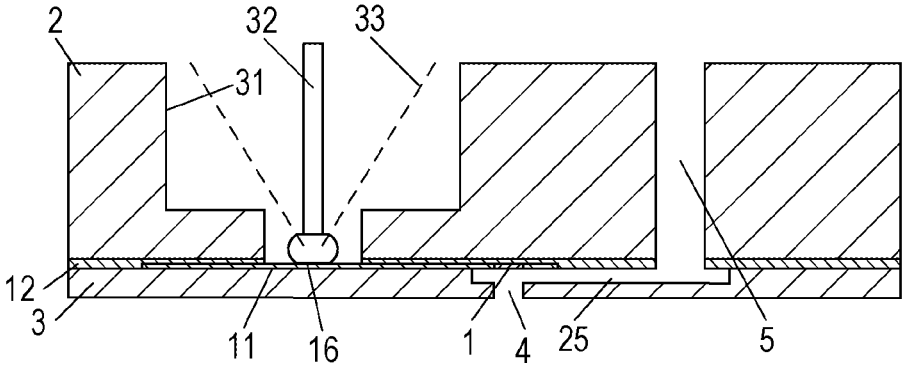
FIG. 7D is a schematic view in which electric connection is established.

Subsequently, the terminals 16 and the terminals 17 (FIG. 3) are electrically connected to each other with the electric connection members 32, which are wire members, by wire lead bonding (step 4 in FIG. 6, FIG. 7D). The bonding tool enters the hole portion 31 from the back surface side of the element substrate and performs wire lead bonding on the terminals 16. The broken lines 33 in FIG. 7D are lines illustrating the area where the bonding tool may enter. By forming the opening width of the hole portion 31 on the side on which masking has been performed larger than the opening width on the terminal 16 side, the bonding tool can perform electric connection without interfering the substrate portion 2 while maintaining the strength of the substrate portion 2.

Subsequently, the sealing member 63 (FIG. 3) is injected inside the hole portion 31, and the terminals 16, the terminals 17 (FIG. 3), and the electric connection members 32 are sealed with the sealing member 63 (step 5 in FIG. 6). Lastly, the element substrate 10 and the head member 52 are fixed to each other using the seal member 62 (step 6 in FIG. 6). Note that in the present example embodiment, the electric connection between each energy generating element 1 and the corresponding terminal 16 is established by wire lead bonding; however, the present disclosure is not limited to the above. For example, a so-called flying lead in which the wire extends externally may be used to establish each electric connection.

Second Example Embodiment

Figure 8:
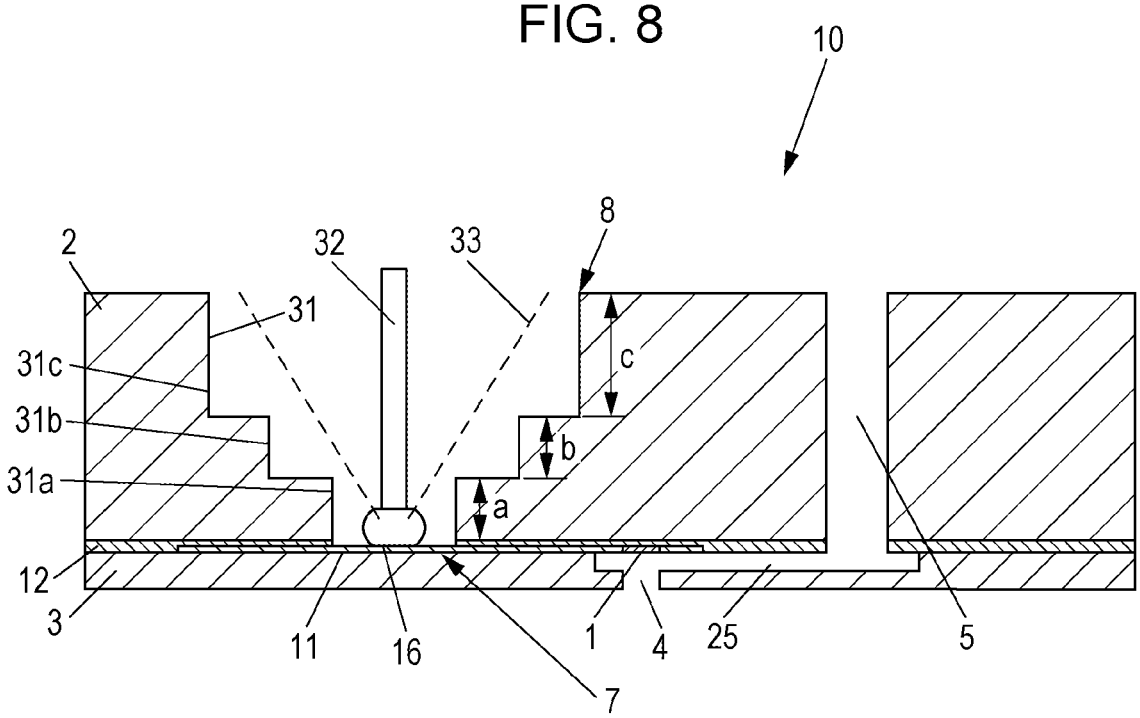
FIG. 8 is a schematic view illustrating an element substrate according to a second example embodiment.

Referring to FIG. 8, a second example embodiment of the present disclosure will be described. Components similar to those of the first example embodiment will be attached with the same reference numerals and description thereof will be omitted. FIG. 8 is a schematic view of a cross section taken along line VIII-VIII in FIG. 2B illustrating a portion of the element substrate 10 according to the present example embodiment. A feature portion of the present example embodiment is that three portions having areas of different sizes in the direction orthogonal to the depth direction of the hole portion 31 are formed in the hole portion 31 while preventing interference with the bonding tool.

Since wire lead bonding using pieces of Au wire as the electric connection members 32 is performed, the bottom portion 7 of the hole portion 31 needs to have a width of at least 150 μm. Furthermore, similar to the first example embodiment, since the bonding tool enters the hole portion 31, the acute angle formed between each of the broken lines 33 and the plane of the wiring layer 11 is, for example, about 60 degrees. In the present example embodiment, a thickness of the substrate portion 2 is 650 μm, a height a of the portion 31*a* is 250 μm, and an opening width is 300 μm. Furthermore, an opening width of the bottom portion 7 of the hole portion 31 is 300 μm, which is the same as the opening width of the portion 31*a*. A height b of the portion 31*b* is 200 μm, and the opening width thereof is 550 μm. A height c of a portion 31*c* is 200 μm, and an opening width thereof is 800 μm.

The hole portion 31 of the present example embodiment is formed by performing reactive ion etching three times. Other steps for fabricating the element substrate 10 is similar to those of the first example embodiment.

By providing portions having areas of different sizes at three portions in the hole portion 31, more of the substrate portion 2 will remain around the terminal 16 than in the case of the element substrate 10 according to the first example embodiment. Accordingly, the strength of the element substrate 10 is improved further by the thickness of the substrate portion 2 and the deformation of the element substrate 10 can be suppressed further.

Note that in the present example embodiment, while there are three portions having areas of different sizes in the hole portion 31, the present disclosure is not limited to the above, and the hole portion 31 may, regarding the areas in the direction orthogonal to the depth direction of the hole portion 31, have three or more portions having different sizes. By having the shape of the hole portion 31 include more steps from the bottom portion 7 to an uppermost surface 8, the substrate portion 2 will have more thickness around the hole portion 31 and the deformation of the element substrate 10 can be suppressed further. By increasing the number of times of reactive ion etching, an element substrate 10 in which the opening areas of the hole portion change further stepwise can be fabricated.

Third Example Embodiment

Figure 9:
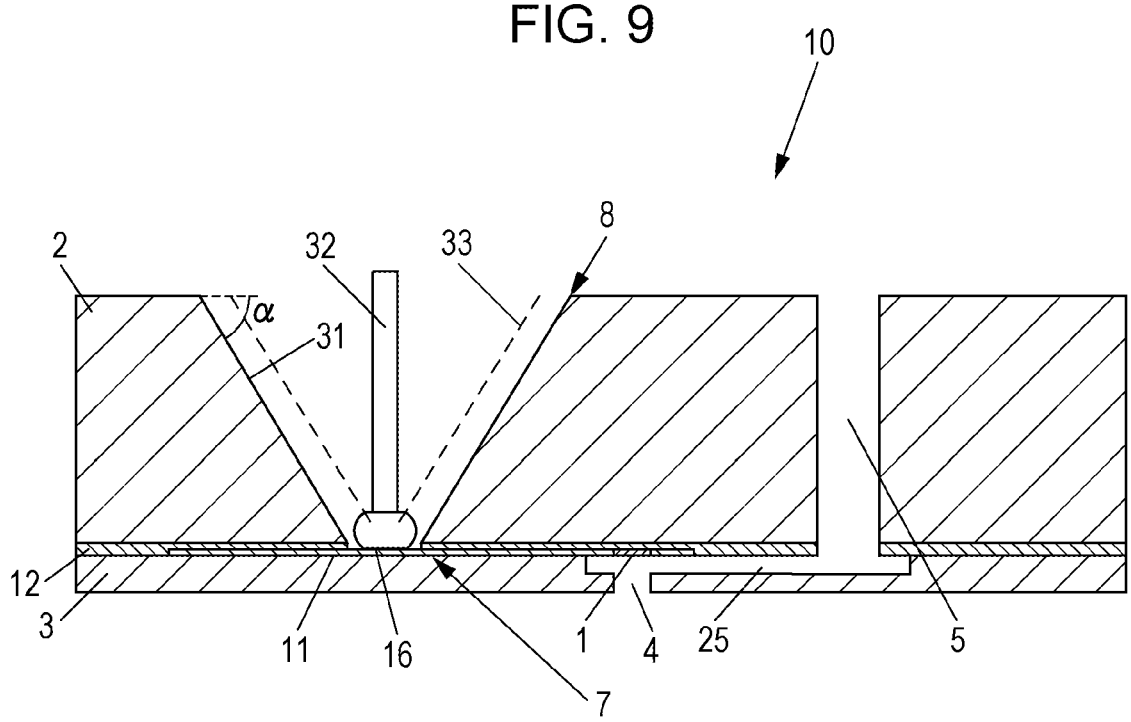
FIG. 9 is a schematic view illustrating an element substrate according to a third example embodiment.

Referring to FIG. 9, a third example embodiment of the present disclosure will be described. Components similar to those of the first example embodiment will be attached with the same reference numerals and description thereof will be omitted. FIG. 9 is a schematic view of a cross section taken along line IX-IX in FIG. 2B illustrating a portion of the element substrate 10 according to the present example embodiment. A feature portion of the present example embodiment is that the area of the hole portion 31 in the direction orthogonal to the depth direction of the hole portion 31 becomes gradually larger while preventing interference with the bonding tool.

Since wire lead bonding using pieces of Au wire as the electric connection members 32 is performed, the bottom portion 7 of the hole portion 31 needs to have a width of at least 150 μm. In the present example embodiment, a thickness of the substrate portion 2 is 650 μm, and an opening width of the bottom portion 7 of the hole portion 31 is 150 μm. An opening width of the uppermost surface 8 of the hole portion 31 is 1070 μm.

In order to form the hole portion 31 having such a tapered shape as in the present example embodiment in the substrate portion 2, the substrate portion 2 is processed by anisotropic wet etching. Since the crystal orientation of silicon is related to the anisotropic wet etching, an angle $\alpha$ formed between the uppermost surface 8 and a wall surface of the hole portion 31 is 54.7 degrees. When the substrate portion 2 is processed using anisotropic wet etching, the insulating layer 12 is also removed to expose the terminals 16 of the wiring layer 11. By gradually increasing the opening area of the hole portion 31 towards the uppermost surface 8, more of the substrate portion 2 will remain around the terminal 16. Accordingly, the strength of the element substrate 10 is improved by the thickness of the substrate portion 2 and the reliability of each electric connection portion is improved.

Fourth Example Embodiment

Figure 10:
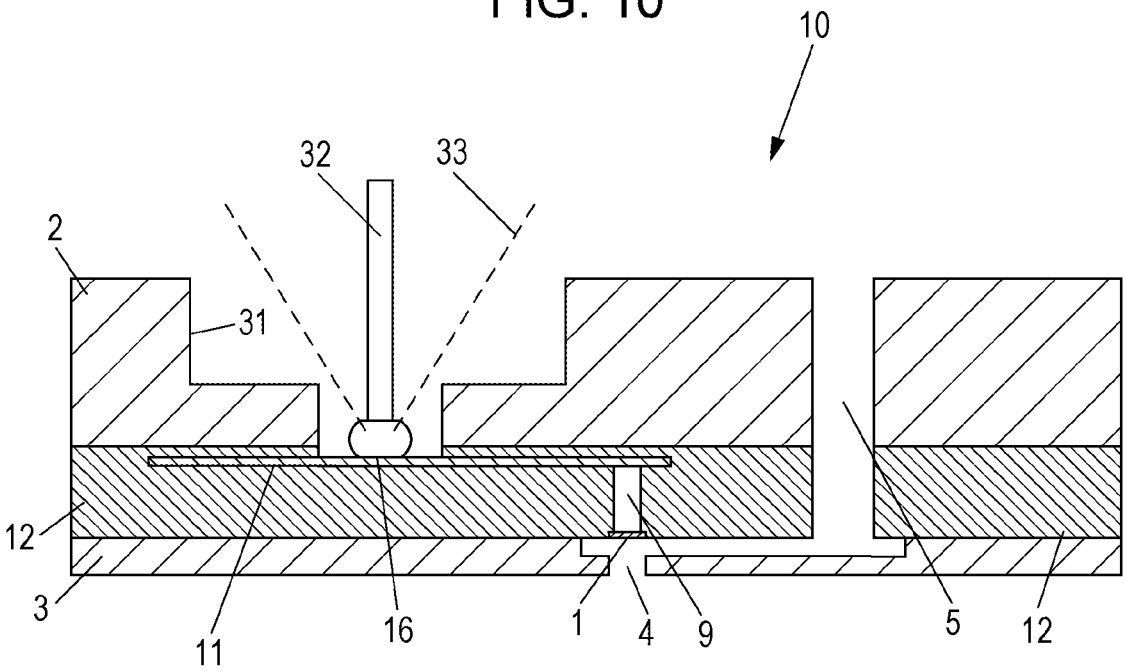
FIG. 10 is a schematic view illustrating an element substrate according to a fourth example embodiment.

Referring to FIG. 10, a fourth example embodiment of the present disclosure will be described. Components similar to those of the first example embodiment will be attached with the same reference numerals and description thereof will be omitted. FIG. 10 is a schematic view of a cross section taken along line X-X in FIG. 2B illustrating a portion of the element substrate 10 according to the present example embodiment. A feature point of the present example embodiment is that each energy generating element 1 and the corresponding terminal 16 are electrically connected to each other using a through hole 9. Owing to the through hole 9, even in a case in which the wiring layer 11 is formed in a layer that is different from that of the energy generating element 1, a thickness that suppresses the deformation of the element substrate 10 can be obtained in a portion around the terminal 16. Furthermore, as illustrated in the drawing, by having the hole portion 31 have a shape illustrated in the first example embodiment, a larger thickness can be obtained around each terminal 16 and the deformation of the element substrate 10 can be suppressed further. Note that for the sake of description, while only one layer is provided in the wiring layer 11 in FIG. 10, a plurality of wiring layers may be formed between the energy generating element 1 and the terminal 16.

Fifth Example Embodiment

Figure 11:
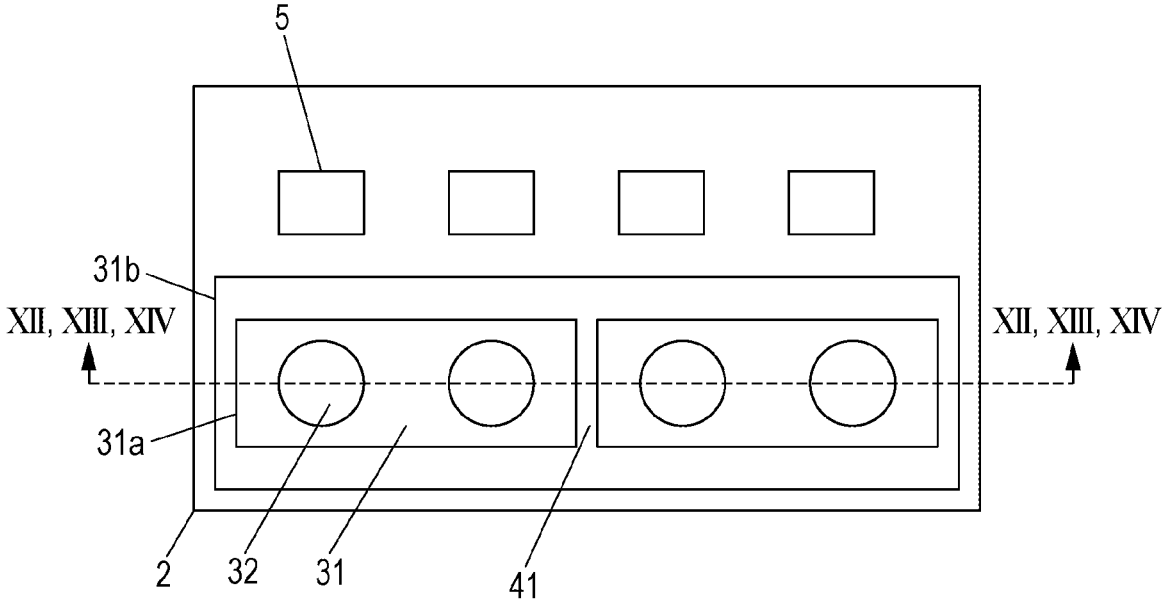
FIG. 11 is a schematic view of an element substrate according to a fifth example embodiment viewed in a direction XI in FIG. 4.
Figure 12:
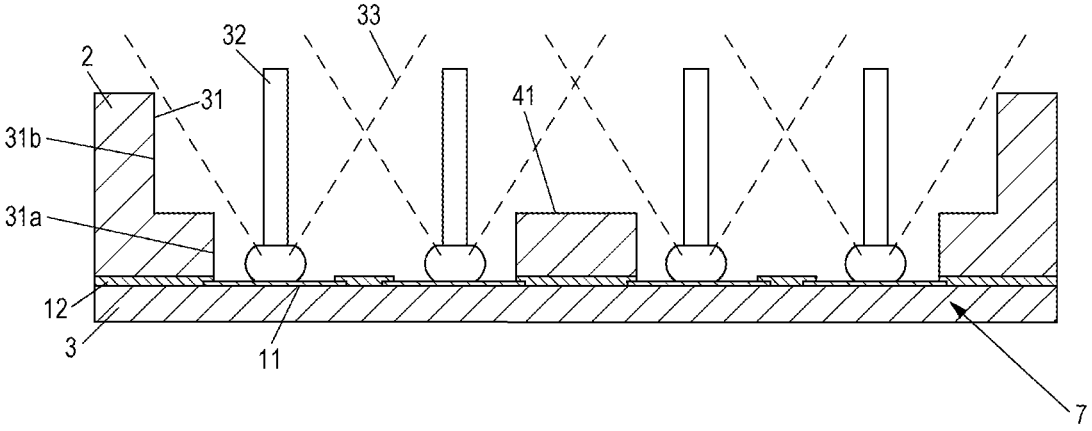
FIG. 12 is a schematic view of a cross section of the element substrate according to the fifth example embodiment taken along line XII-XII in FIG. 11.
Figure 13:
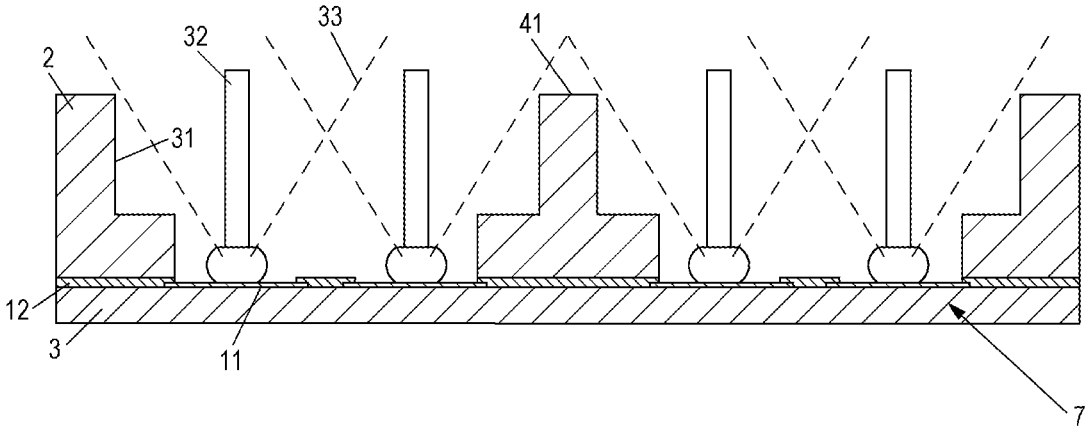
FIG. 13 is a schematic view of a cross section of the element substrate according to the fifth example embodiment taken along line XIII-XIII in FIG. 11.
Figure 14:
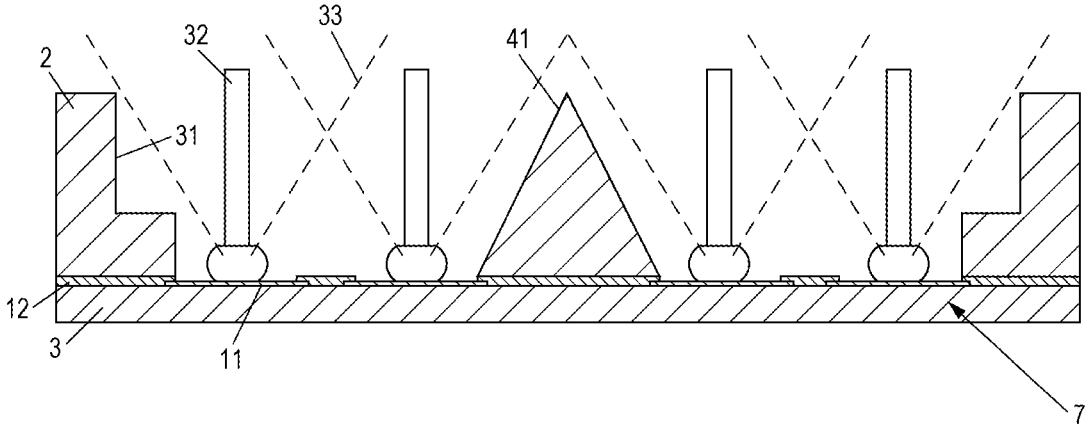
FIG. 14 is a schematic view of a cross section of the element substrate according to the fifth example embodiment taken along line XIV-XIV in FIG. 11.

Referring to FIGS. 11 to 14, a fifth example embodiment of the present disclosure will be described. Components similar to those of the first example embodiment will be attached with the same reference numerals and description thereof will be omitted. FIG. 11 is a schematic view of the element substrate 10 according to the present example embodiment viewed in a direction XI illustrated in FIG. 4. FIG. 12 is a schematic view illustrating a cross section of the element substrate 10 taken along line XII-XII in FIG. 11. FIGS. 13 and 14 are diagrams illustrating modification examples of FIG. 12, in which shapes of the beams are different. As illustrated in FIGS. 12 to 14, a feature portion of the present example embodiment and the modification examples thereof is that a beam 41 is provided in a middle portion of the hole portion 31 in an array direction of the electric connection members 32. The beam illustrated in FIG. 12 has a rectangular parallelepiped shape. A height thereof is 250 pun and a width thereof is 600 μm. The beam illustrated in FIG. 13 has a shape in which two rectangular parallelepipeds are stacked, in which the rectangular parallelepiped on a first level is 250 μm in height and 900 μm in width. The rectangular parallelepiped on a second level is 400 μm in height and 300 μm in width. The beam illustrated in FIG. 14 has a tapered shape.

By providing a beam having such a shape on the bottom portion 7 of the hole portion 31, the deformation of the element substrate 10 in the array direction of the electric connection members 32 is suppressed, and the reliability of each electric connection portion is improved. Note that in the present example embodiment and the modification examples thereof, the shape of the beam 41 is not limited to those illustrated in FIGS. 12 to 14, and may be any shape that suppresses the deformation of the element substrate 10 in the array direction of the electric connection members 32. Furthermore, the hole portion 31 according to the present example embodiment and the modification examples thereof is, similar to the first example embodiment, shaped so as to have two portions that have different opening areas. The manufacturing method thereof is reactive ion etching that is similar to that of the first example embodiment.

Note that in the present example embodiment and the modification examples thereof, a single beam 41 is provided for two electric connection members 32; however, the present disclosure is not limited to the above and, for example, a single beam 41 may be provided for 20 electric connection members 32. A similar effect can be obtained. Furthermore, as illustrated in FIG. 11, in the present example embodiment and the modification examples thereof, the electric connection members 32 are arranged linearly; however, the present disclosure is not limited to the above and the electric connection members 32 may be arranged in a staggered manner. Furthermore, in the example embodiment and the modification examples described above, the shapes of the hole portion 31 and the beam 41 may be described as a rectangle; however, not limited to the above, various shapes, such as a cylindrical shape, a round shape, a triangular shape, and the like may be adopted as long as a similar effect can be obtained.

Sixth Example Embodiment

Figure 15A:
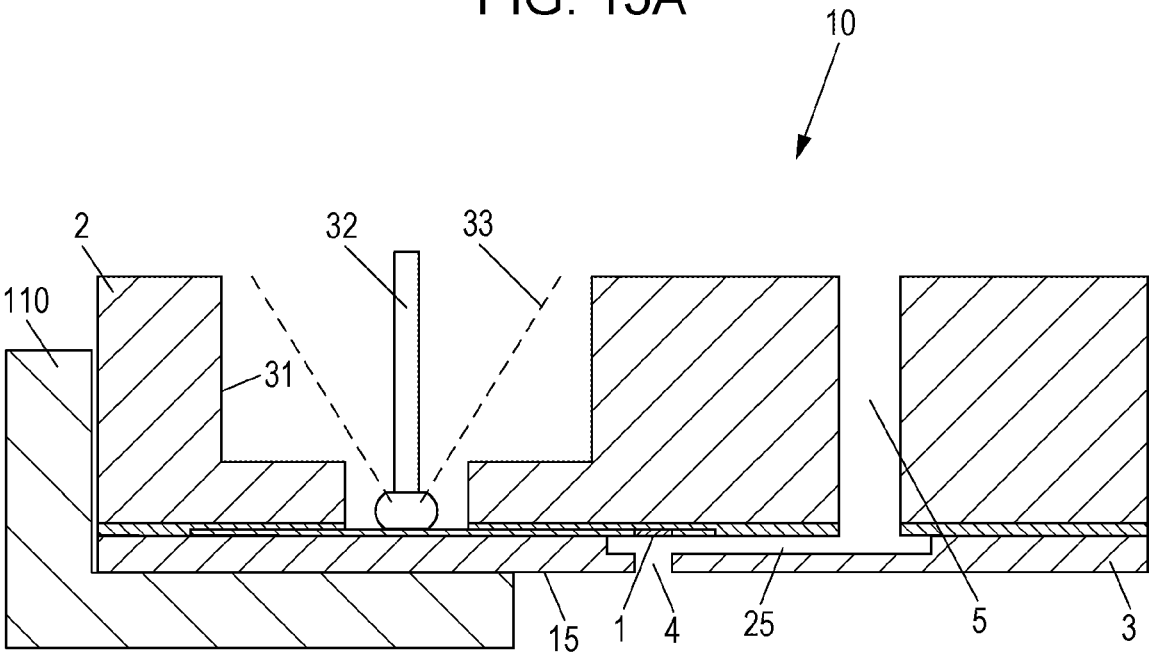
FIG. 15A is a schematic view illustrating an element substrate according to a sixth example embodiment.
Figure 15B:
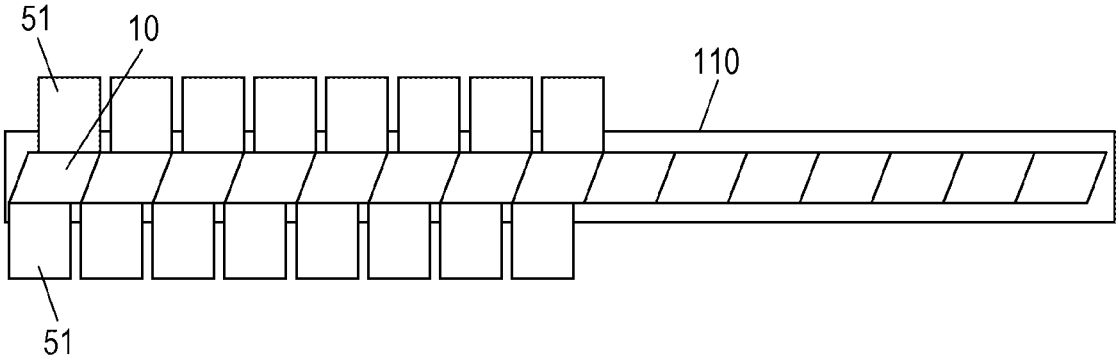
FIG. 15B is a schematic view illustrating the element substrates and a fixing member.

A liquid ejection head according to a sixth example embodiment will be described with reference to FIGS. 15A and 15B. Components similar to those of the first example embodiment will be attached with the same reference numerals and description thereof will be omitted. A feature portion of the present example embodiment is that the element substrates 10 are attached to a fixing member 110 so that an ejection port surface 15 in which the ejection ports 4 of the ejection port member 3 is provided abuts against the fixing member. FIG. 15A is a schematic view of a cross section taken along line XVA-XVA in FIG. 2B illustrating a portion of the element substrate 10 according to the present example embodiment. FIG. 15B is a schematic view of the plurality of element substrates 10, which are attached to the fixing member 110, and the fixing member 110 viewed from the back surface side of the element substrates 10. As illustrated in FIG. 15B, the fixing member 110 has a frame shape that includes an opening portion through which the element substrates 10 are exposed. An adhesive agent is used to fix an inner surface side of the frame and the element substrates 10 to each other.

As illustrated in FIG. 15A, in the present example embodiment, the fixing member 110 is provided so as to correspond to the positions where the hole portions 31 are provided. In other words, when viewed in the direction of FIG. 15B, the hole portions 31 and the frame of the fixing member 110 are positioned so as to overlap each other. This is desirable because the strength of the element substrates 10 where the hole portions 31 are situated is improved. While various materials such as resin, metal, or the like can be applied as the material of the fixing member 110, metal such as SUS is desirable from the viewpoint of strength. Furthermore, while resin is applicable, from the viewpoint of strength, it is desirable that resin containing filler is applied.

A joining portion between a recording apparatus main body (not shown) and the liquid ejection head 6 is provided in a support member 18 (FIG. 1) that supports the fixing member 110. The fixing member 110 is attached to the support member 18. Furthermore, the element substrates 10 are attached to the fixing member 110. Accordingly, while a standard for positioning the element substrates 10 is the fixing member 110, since the joining portion with the liquid ejection head 6 is in the support member 18 situated in the vicinity of the fixing member 110, the influence of dimensional tolerances of various components of the liquid ejection head 6 on the positional accuracy of the element substrates 10 is small. Accordingly, the configuration of the present example embodiment is desirable from the viewpoint of positional accuracies of the element substrates 10 with respect to the recording apparatus. Furthermore, from the viewpoint of dimensional accuracy, it is further desirable that the joining portion between the recording apparatus and the liquid ejection head 6 is provided in the fixing member 110 since the distance between the joining portion and the element substrates 10 becomes smaller.

Comparative Example

Figure 16:
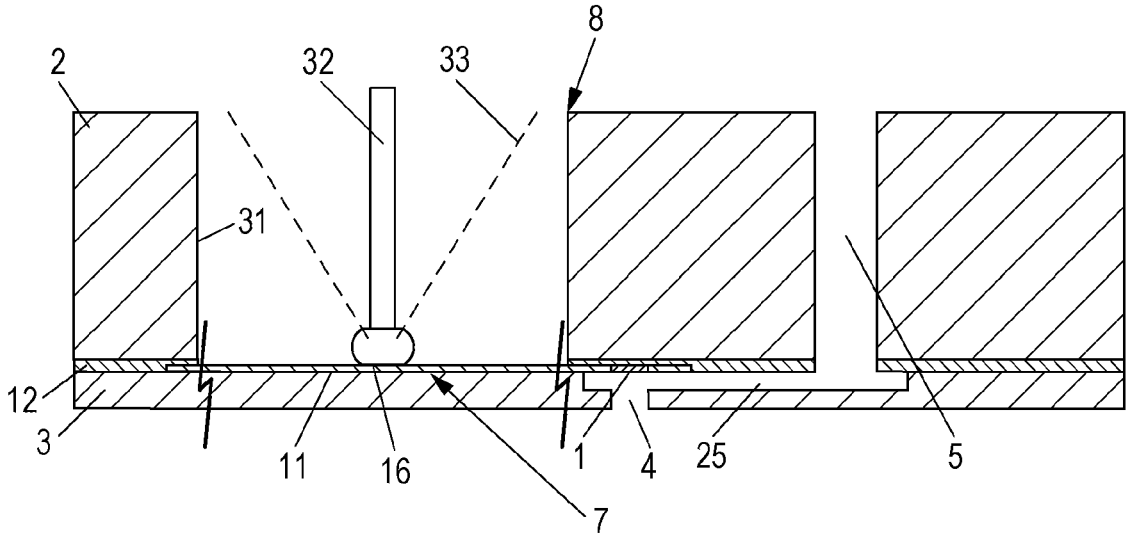
FIG. 16 is a schematic view illustrating an element substrate according to a comparative example.

A comparative example of the present disclosure will be described with reference to FIG. 16. Components similar to those of the first example embodiment will be attached with the same reference numerals and description thereof will be omitted. FIG. 16 is a schematic view of a cross section of an element substrate according to the comparative example viewed along line XVI-XVI in FIG. 2B. A point different from the first example embodiment is that the hole portion 31 is formed from the uppermost surface 8 to the bottom portion 7 with the same opening area. In the present comparative example, the opening width of the hole portion 31 is 800 μm from the uppermost surface 8 to the bottom portion 7. When such a hole portion 31 is formed in the substrate portion 2, only the ejection port member 3 is formed around the terminals 16; accordingly, the element substrate 10 cannot obtain a thickness sufficient enough to maintain the shape as a normal element substrate. With the above, there are cases in which the element substrate starts to become deformed from the edge portion of the hole portion 31.

The present disclosure is, in an element substrate including electric connection portions inside a hole portion providing a liquid ejection head in which a deformation of the element substrate is suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-125045, filed Jun. 29, 2018, which is hereby incorporated by reference herein in its entirety.

What is claimed is:

1. A liquid ejection head comprising:

an ejection port member that includes an ejection port that ejects a liquid;

an energy generating element that generates energy for ejecting the liquid from the ejection port;

a terminal electrically connected to the energy generating element; and a substrate portion that supports the ejection port member, the energy generating element, and the terminal, wherein the terminal is connected to a wire member that supplies electric power that drives the energy generating element to the energy generating element, wherein the substrate portion includes a hole portion formed from a surface of the substrate portion on a side opposite to a surface of the substrate portion on which the terminal is provided to a surface where the terminal is exposed, and wherein an area of the surface of the substrate where the terminal is exposed is smaller than an area of an opening of the hole portion, wherein the wire member is a wire for wire lead bonding or a flying lead wire, and wherein the wire member is not directly in contact with a side wall surface of the hole portion.

2. The liquid ejection head according to claim 1, wherein the hole portion includes three or more portions that have areas of different sizes in a direction orthogonal to a depth direction of the hole portion.

3. The liquid ejection head according to claim 1, wherein an area of the hole portion in a direction orthogonal to a depth direction of the hole portion becomes gradually larger towards the surface of the substrate portion on the side opposite to the surface on which the terminal is provided.

4. The liquid ejection head according to claim 1, wherein a plurality of terminals electrically connected to the energy generating element are exposed through the hole portion.

5. The liquid ejection head according to claim 4, wherein a beam is formed on a surface where the terminals are exposed.

6. The liquid ejection head according to claim 5, wherein the beam has a rectangular parallelepiped shape.

7. The liquid ejection head according to claim 5, wherein regarding an area of the beam in a direction orthogonal to a depth direction of the hole portion, a surface area on a side where the terminals are exposed is larger than a surface area on a side close to the opening.

8. The liquid ejection head according to claim 7, wherein the beam has a tapered shape in which an area thereof in the direction orthogonal to the depth direction of the hole portion becomes gradually larger towards the surface where the terminals are exposed.

9. The liquid ejection head according to claim 5, wherein the beam is formed in a middle portion of the surface where the terminals are exposed.

10. The liquid ejection head according to claim 1, further comprising:

a fixing member that abuts against an ejection port surface in which the ejection port of the ejection port member is provided.

11. The liquid ejection head according to claim 1, wherein a connection portion between the terminal and the wire member is sealed with a sealing member.

12. The liquid ejection head according to claim 1, wherein the liquid ejection head is a page-wide head corresponding to a width of a medium to be printed.

13. The liquid ejection head according to claim 12, further comprising:

a plurality of element substrates each including the ejection port member, the energy generating element, the terminal, and the substrate portion, wherein the plurality of element substrates are disposed in a staggered manner in a longitudinal direction of the liquid ejection head.

14. The liquid ejection head according to claim 12, further comprising:

a plurality of element substrates each including the ejection port member, the energy generating element, the terminal, and the substrate portion, wherein the plurality of element substrates are disposed linearly in a longitudinal direction of the liquid ejection head.

15. The liquid ejection head according to claim 14, wherein the element substrates each have a substantially parallelogram shape.

16. The liquid ejection head according to claim 1, wherein a shape of the hole portion is multi-stepped shape.

17. The liquid ejection head according to claim 16, wherein the shape of the hole portion is double-stepped shape.

18. The liquid ejection head according to claim 16, wherein the shape of the hole portion is triple-stepped shape.

19. The liquid ejection head according to claim 1, wherein the energy generating element is a heater.

* * * * *